US006239089B1

(12) United States Patent
Cala et al.

(10) Patent No.: US 6,239,089 B1
(45) Date of Patent: May 29, 2001

(54) AQUEOUS CLEANING SOLUTIONS CONTAINING ELEVATED LEVELS OF N-ALKYL-2-PYRROLIDONE

(75) Inventors: Francis R. Cala, Highland Park, NJ (US); Jennifer Lynn Kester, Warminster, PA (US)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 09/439,985

(22) Filed: Nov. 12, 1999

(51) Int. Cl.[7] ..... C11D 1/14; C11D 3/28; C11D 3/10

(52) U.S. Cl. ..... 510/175; 519/163; 519/166; 519/167; 519/170; 519/178; 519/245; 510/254; 510/265; 510/272; 510/274; 510/427; 510/433; 510/500

(58) Field of Search ..... 510/163, 166, 510/167, 170, 175, 178, 245, 254, 265, 272, 274, 427, 433, 500

(56) References Cited

U.S. PATENT DOCUMENTS

| | | | |
|---|---|---|---|
| 5,234,505 | 8/1993 | Winston et al. | 134/40 |
| 5,234,506 | 8/1993 | Winston et al. | 134/40 |
| 5,464,553 | 11/1995 | Winston et al. | 510/255 |
| 5,549,761 | 8/1996 | Winston et al. | 134/40 |
| 5,575,857 | 11/1996 | Lunski et al. | 134/2 |
| 5,593,504 | 1/1997 | Cala et al. | 134/1 |
| 5,688,753 | 11/1997 | Cala et al. | 510/175 |
| 5,693,601 * | 12/1997 | Iakovides et al. | 510/191 |
| 5,755,893 | 5/1998 | Cala et al. | 134/2 |

OTHER PUBLICATIONS

Hornby et al.; "Surface Active Specialty Solvents"; Soap/Cosmetics Chemical Specialties; pp. 52–58 (Sep. 1992).

Union Carbide Corporation; "Triton® Surfactants —TRITON® H–55, H–66, and QS–44 Hydrotropes", pp. 1–15 (1996).

Stepan Product Bulletin; "BIO–TERGE® PAS–8S". pp. 1–2 (Sep. 1997) and Material Safety Data Sheet pp. 1–5 (Feb. 6, 1998).

* cited by examiner

*Primary Examiner*—Gregory Delcotto
(74) *Attorney, Agent, or Firm*—Irving M. Fishman

(57) ABSTRACT

Aqueous cleaning solution concentrates with elevated levels of N-alkyl-2-pyrrolidone solubilized therein, comprising a surfactant formulation incorporating at least one N-alkyl-2-pyrrolidone, the alkyl group of which has 6 to 12 carbon atoms, and a $C_{6-10}$ alkane sulfonate hydrotrope for the N-alkyl-2-pyrrolidone in a hydrotrope/pyrrolidone weight ratio of 0.9 to 5.0%.

16 Claims, 5 Drawing Sheets

AQUEOUS CLEANING SOLUTIONS CONTAINING ELEVATED LEVELS OF N-ALKYL-2-PYRROLIDONE

FIELD OF THE INVENTION

The present invention relates to aqueous cleaning solution concentrates with elevated levels of N-alkyl-2-pyrrolidone solubilized therein.

BACKGROUND OF THE INVENTION

Aqueous cleaning compositions containing alkaline salts, surfactants and other adjuvants have been recently developed to clean a wide variety of surfaces. These aqueous salt cleaners are particularly advantageous since the cleaners are effective and safe to use, handle and dispose of and, accordingly, can replace the more harmful, environmentally unsafe highly basic or organic-based solvents and cleaners previously utilized. Among the particularly useful aqueous cleaners are those which have been developed by the assignee of the present invention, which are based on alkali metal carbonates and/or bicarbonates.

Separate cleaners have been developed for cleaning different surfaces. One such application involves cleaning flux residues from electronic circuit assemblies. Compositions designed for this purpose are disclosed, for example, in U.S. Pat. Nos. 5,234,505; 5,234,506; 5,549,761; 5,575,857; 5,593,504; 5,688,753; and 5,755,893; all of which are assigned to the assignee of the present invention. The aqueous alkaline salt-based cleaners used for this purpose are marketed under the trademark ARMAKLEEN®. These cleaners are finding increasing acceptance as replacements for the halogenated hydrocarbon and other volatile organic solvents previously used to remove flux residues, in particular, rosin flux residues.

Other applications for which aqueous alkaline salt-based cleaners find application include the cleaning of glass molds utilized for the preparation of optical lenses, or glass lenses prior to the application of optical coatings thereon. Such glass mold surfaces are subject to the accumulation of residues from the resins used in manufacturing operations and must be cleaned before the formation of lenses.

N-alkyl-2-pyrrolidones have been found to be particularly effective as surfactants in the aqueous alkaline salt-based cleaners utilized for the foregoing and other precision cleaning applications, as well as for heavier industrial cleaning, such as in the automobile parts industry. The N-alkyl-2-pyrrolidones function as solvents and are very surface active. The pyrrolidone ring of the N-alkyl-2-pyrrolidone functions as the hydrophilic head and the alkyl group (R) functions as the hydrophobic tail. One well recognized example of this type of surfactant is N-methyl-2-pyrrolidone.

The N-alkyl-2-pyrrolidones which are particularly attractive for the formulation of water based cleaners are those wherein the attached alkyl group (R) has 7 to 12 carbon atoms. One company which manufactures specialty solvents of this type is International Specialty Products of Wayne, N.J., which offers its Surfadones®, namely Surfadone® LP 100, in which $R=CH_3(CH_2)_7$ and Surfadone® LP 300, in which $R=CH_3(CH_2)_{11}$.

Although the N-alkyl-2-pyrrolidones can be effective at relatively low concentrations (e.g. 0.05% in wash waters), both the literature and practical experience show that their solubility is severely limited in aqueous based systems. International Specialty Products, for example, indicates that single phase systems are produced with concentrations of LP 100 up to 0.12% and LP 300 up to 0.002%. Homby, J. C. and Domingo, J., "Surface Active Agents," *Soap/Cosmetics/Chemical Specialties,* September 1992, incorporated by reference herein. These maximum solubilities are quite low. In addition, practical experience has shown that higher concentrations (e.g., 0.2 to 1.0% on a 100% actives basis) of the N-alkyl-2-pyrrolidones may be required for the removal of tough soils. The difficulty of solubilizing elevated concentrations of these materials is found in both the undiluted, aqueous concentrates as received from the manufacturer (also referred to as the "neat product"), and in the corresponding aqueous, diluted solutions.

It has previously been proposed to add a hydrotrope to alkaline salt-based cleaning compositions to maintain the organic constituents thereof, including the surfactants, readily dispersed in the aqueous cleaning solutions and, in particular, in the aqueous concentrates preferred for marketing the compositions. Addition of a hydrotrope permits a user to accurately provide the desired amount of the cleaning composition in an aqueous wash cleaner solution. U.S. Pat. Nos. 5,688,753 and 5,755,893 discussed above (in which one of the present inventors is a named co-inventor) disclose the use, as hydrotropes for salt-containing concentrates incorporating N-alkyl pyrrolidone surfactants, of alkali metal salts of $C_7$–$C_{13}$ linear monocarboxylic fatty acids; alkali metal, ammonium and alkanolammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and alkali metal and ammonium salts of the alkyl sarcosinates.

It is among the objects of the present invention to provide aqueous cleaning concentrates and the corresponding aqueous cleaning solutions, which contain elevated levels of an N-alkyl-2-pyrrolidone surfactant and a particular type of hydrotrope for the N-alkyl-2-pyrrolidone which facilitates solubilizing substantially increased amounts of such surfactant in stable, homogeneous form in such aqueous concentrates and solutions.

It is another object of the present invention to provide a cleaning solution concentrates and aqueous cleaning solutions as just described, which also include alkaline salt and an antifoaming agent.

These and other objects of the invention will become readily apparent upon consideration of the following detailed description of the invention, taken in connection with the accompanying drawings.

SUMMARY OF THE INVENTION

The aqueous cleaning concentrates and solutions and methods of this invention allow for an increased amount of N-alkyl-2-pyrrolidone to be incorporated therein, in concentrations of up to about 10% to 20% wt. %, for the undiluted concentrate (or 1.0%–2.0% for a 10% diluted solution) while maintaining such concentrates/solutions in stable, homogenous form. This invention also provides a method for effecting improved removal of residues from glass, metal, ceramic and electronic articles by contacting such articles with such concentrates or solutions.

The formulations of the invention are not corrosive, provide anti-corrosive protection, and have low environmental impact, unlike the chlorinated hydrocarbon solvents and highly alkaline cleaners that have heretofore been employed.

The aqueous cleaners of this invention are characterized by a pH of less than 12.0 and are clear solutions which are effective in removing all traces of residues.

In accordance with the invention, the aqueous cleaning solution concentrate incorporates a surfactant formulation including at least one N-alkyl-2-pyrrolidone having 6 to 12 carbon atoms in the alkyl group thereof and being present in an amount of about 1.5 to 20 wt. % of the concentrate. The cleaning composition also includes a $C_6$–$C_{10}$ alkane sulfonate hydrotrope for the N-alkyl-2-pyrrolidone in a hydrotrope/pyrrolidone weight ratio of about 0.9 to 5.0. It has been found, in accordance with the present invention, that it is the use of these particular types of hydrotropes which maintain the N-alkyl-2-pyrrolidone surfactant in stable, homogeneous aqueous cleaning concentrates and solutions.

The aqueous cleaning concentrate contains about 0–20 wt. % of a surfactant system, excluding the pyrrolidone. The N-alkyl-2-pyrrolidone comprising about 1.5 to 20.0 wt. % of the concentrate composition. The alkaline salt cleaning agent comprises the predominant portion of the remainder of the cleaning composition, ranging from about 1 to 15 wt. % thereof.

DETAILED DESCRIPTION OF THE INVENTION

Figure 1:
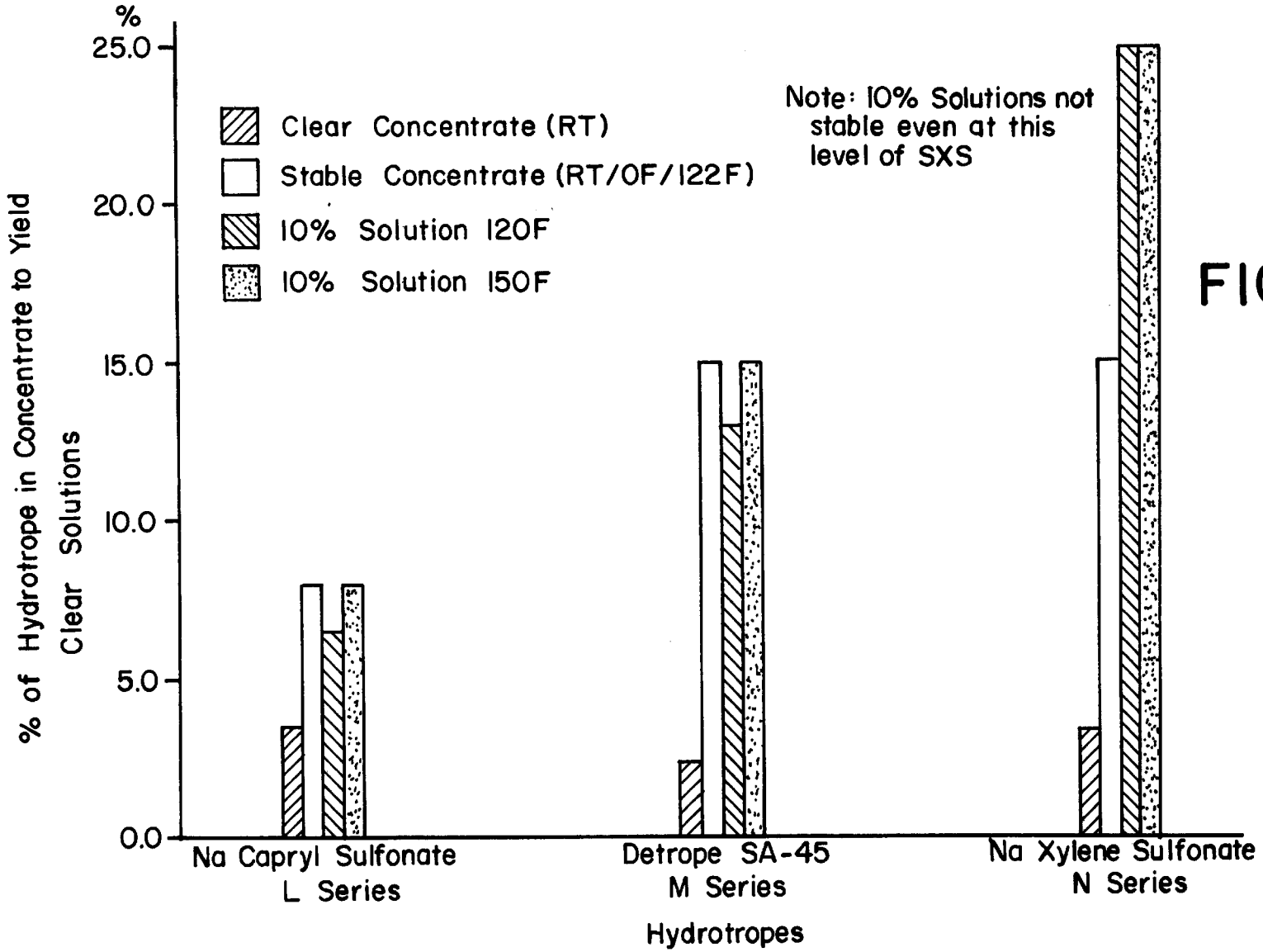
FIG. 1 is a graph illustrating the percentages of different hydrotropes required to solubilize N-octyl pyrrolidone (Surfadone® LP 100) in aqueous cleaning concentrates and 10% solutions, under different conditions.

The objects and advantages mentioned above as well as other objects and advantages may be achieved by the compositions and methods hereinafter described.

The cleaners of the present invention are aqueous cleaning solution concentrates containing about 1.5 to 20 wt. % of the N-alkyl-2-pyrrolidone and, correspondingly, about 3.0 to 25 wt. % of the sodium alkane sulfonate hydrotrope therefor.

The aqueous solution concentrates may be incorporated into a cleaning composition incorporating at least an alkaline salt in an amount sufficient to impart a pH greater than about 10.0 and up to about 12.0 to aqueous solutions of the composition, a surfactant formulation including at least one N-alkyl-2-pyrrolidone and an alkane sulfonate hydrotrope for the N-alkyl-2-pyrrolidone. As used herein, the term "cleaning composition" refers to the mixture of actives including the foregoing ingredients and any additional adjuvants such as described hereinafter.

The cleaning ingredients are preferably formulated into an aqueous "concentrate" which may contain from 5% to 50% or more of the cleaning composition with the balance being essentially water. It is frequently convenient to market the cleaning composition in the form of such an aqueous concentrate.

The cleaning compositions, concentrates and solutions of this invention comprise surfactant systems, alkane sulfonate hydrotropes, and alkaline salts and alkaline salt mixtures which have yielded vast improvements in cleaning efficacy, formulation, clarity, and viscosity. Most importantly, the claimed invention provides cleaning solutions having increased stability as compared to prior art formulations.

The claimed cleaning compositions, concentrates and solutions are especially useful in the cleaning of glass lenses in the course of their manufacture. In particular, the claimed cleaning compositions, concentrates and solutions are used to remove residues left on the lenses during manufacture prior to treatment of the lenses with various coatings. Moreover, the claimed cleaning compositions, concentrates and solutions are used to clean the molds used to manufacture the lenses themselves by removing residues left behind from the polymer solutions that form the lenses.

A. The Concentrate

The cleaning composition of the invention thus includes the foregoing ingredients, in the following amounts (based on 100% actives):

| | |
|---|---|
| alkaline salts | 1–15 wt. % |
| surfactant formulation(excluding n-alkyl pyrrolidone) | 0–20 wt. % |
| N-alkyl-2-pyrrolidone | 1.5–20 wt. % (preferably, 2 to 4 wt. %) |
| alkane sulfonate hydrotrope | 3–25 wt. % |
| alkali metal silicate | 0–10 wt. % |
| antifoaming agent | 0–8 wt. % |
| water | q.s. |

As indicated above, the cleaning composition is preferably marketed in the form of an aqueous concentrate. Such aqueous cleaning concentrate may contain about 5 to 50 wt. % of the cleaning composition. Preferably, the concentrate contains about 10 to 30 wt. % and most desirably, about 15 to 20 wt. % of the cleaning composition (i.e., the carbonate/bicarbonate alkaline salt, the surfactant formulation, the hydrotrope and optional adjuvants such as a silicate salt and antifoaming agent), with the remainder essentially water.

The alkaline cleaning salts incorporated in the concentrate are thus present in amounts of about 1 to 15 wt. %, preferably 7 to 12% and, most desirably, from about 7 to less than 10 wt. % of the concentrate. The bicarbonate salts may be present in amounts of about 0 to 10 wt. %, preferably about 0 to 5 wt. % of the composition. The surfactant system, preferably including a mixture of anionic and nonionic surfactants as well as the N-alkyl-2-pyrrolidone moiety comprise about 1 to 20 wt. %, preferably about 3% to 8 wt. %, of the concentrate. Specifically, the amount of the N-alkyl-2-pyrrolidone in the concentrate is about 0.4 to 10%, preferably, about 1.0 to 5.0 and, most desirably, about 1.5 to 4.0 wt. % of the concentrate. To insure that the N-alkyl-2-pyrrolidone remains in solution, the hydrotrope is preferably added in amounts of about 0.8 to 10 wt. %, most preferably about 2 to 6 wt. % of the concentrate.

B. The Cleaning Composition

The cleaning composition of the present invention contains alkaline salt cleaning agents, preferably alkali metal carbonates or mixtures of alkali metal carbonates and bicarbonates. The alkaline salts which are so useful comprise alkali metal salts such as potassium, sodium and lithium salts, with potassium salts being preferred. The carbonate salts include potassium carbonate, potassium carbonate dihydrate and potassium carbonate trihydrate, and sodium carbonate, sodium carbonate decahydrate, sodium carbonate heptahydrate, sodium carbonate monohydrate, sodium sesquicarbonate and the double salts and mixtures thereof. The bicarbonate salts include potassium bicarbonate, sodium bicarbonate, lithium bicarbonate and mixtures thereof.

As set forth above, the alkali metal carbonate and bicarbonate salts are utilized in combinations and in concentrations such that the cleaning concentrate and the diluted aqueous cleaning or wash solution have a pH of from about greater than 10, to about 13, preferably about 10.7 to 12 and, most preferably, from about 11.0 to 11.6.

Although not preferred, other suitable alkaline salts can be used to replace all or part of the carbonate salts include the alkali metal orthophosphates and complex phosphates. Examples of alkali metal orthophosphates include trisodium or tripotassium orthophosphate. The complex phosphates are especially effective because of their ability to chelate water hardness and heavy metal ions. The complex phosphates include, for example, sodium or potassium pyrophosphates, tripolyphosphates or hexametaphosphates. It is preferred, however, to limit the amount of phosphates contained in the cleaning composition of the invention to less than 1 wt. % (phosphorus) relative to the total amount of alkaline salt in the composition, inasmuch as the phosphates are ecologically undesirable, being a major cause of eutrophication of surface water. Additional suitable alkaline salts which may be substituted in the cleaning composition include the alkali metal borates, silicates, acetates, citrates, tartrates, edates, etc. Such salts should be used in amounts sufficient to provide the solution pH values described above.

The N-alkyl pyrrolidone cationic surfactants incorporated in the surfactant formulation of the invention are described in U.S. Pat. No. 5,093,031, assigned to ISP Investments, Inc., Wilmington, Del., which discloses surface active lactams and is incorporated herein by reference. The N-alkyl pyrrolidone products, having a molecular weight of about 197 to 253 are conveniently prepared by several known processes including the reaction between a lactone having the formula

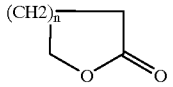

wherein n is an integer from 1 to 3, and an amine having the formula $R^1$—$NH_2$ wherein $R^1$ is a normal alkyl group having 7 to 12 carbon atoms. The amine reactant, having the formula $R^1$—$NH_2$ includes alkylamines having from 7 to 12 carbon atoms; amines derived from natural products, such as coconut amines or tallow amines, distilled cuts or hydrogenated derivatives of such fatty amines. Also, mixtures of amine reactants can be used in the process for preparing the pyrrolidone compounds. Such mixtures can include linear amine species having an alkyl of the same or different molecular weight. To form the pyrrolidone, the amine and lactone reactants, combined in a mole ratio of about 1:1 to 1:5, are reacted under conditions of constant agitation, at a temperature between about 100° C. and about 350° C., under a pressure of from atmospheric to about 650 psig for a period of from about 1 to about 15 hours; preferably at 250° C. to 300° C. under an initial ambient pressure for a period of about 5 to 10 hours. The resulting pyrrolidone product is recovered and purified by distillation or by any other convenient recovery process.

The N-alkyl pyrrolidone products having 7 to 12 carbon atoms are clear, pale yellow liquids, at room temperature. These pyrrolidones are low viscosity liquids having a neutral or slightly basic pH, and a surface tension between about 26 and 33 dynes/cm as a 0.1% water solution. The preferred N-alkyl pyrrolidones utilized in accordance with the present invention are N-octyl pyrrolidone (SURFADONE® LP 100) and N-dodecyl pyrrolidone (SURFADONE® LP 300) from International Specialty Products.

The $C_6$–$C_{10}$ alkane sulfonate hydrotropes for the N-alkyl-2-pyrrolidone are known biodegradable anionic surfactants with excellent coupling properties. Preferably, the alkane sulfonate incorporates 8–10 carbons in the alkyl moiety thereof. Most desirably, sodium capryl sulfonate (C=8) is so utilized; such material is available as a clear aqueous solution (37.8% actives) from the Stepan Company as BIO-TERGE® PAS-83.

In addition to the N-alkyl-2-pyrrolidone, the surfactant formulation incorporated in the cleaning composition of the invention may also include one or more additional surfactants, designed to enhance the wetting and emulsifying characteristics of the final solution and permit maximum penetration thereof within articles that are difficult to clean. The surfactant formulation may thus include one or more nonionic, anionic or amphoteric surfactants, in addition to the N-alkyl-2-pyrrolidone cationic surfactant.

Preferred nonionic surfactants may be characterized as alkoxylated surfactants, including those compounds formed by condensing ethylene oxide with a hydrophobic base formed by the condensation of propylene oxide with propylene glycol. The hydrophobic portion of the molecule which exhibits water insolubility has a molecular weight of about 1,500 to 1,800. The addition of polyoxyethylene radicals to this hydrophobic portion tends to increase the water solubility of the molecule as a whole and the liquid character of the product is retained up to the point where the polyoxyethylene content is about 50 wt. % of the condensation product. Examples of such compositions are the "Pluronics" sold by BASF, including PLURONIC P84 and PLURONIC P85.

In addition, the condensation product of aliphatic alcohols having from 8 to 18 carbon atoms, in either straight chain or branched chain configurations, with ethylene oxide and propylene oxide, e.g., a coconut alcohol-ethylene oxide-propylene oxide condensate having about 1 to 30 moles of ethylene oxide per mole of coconut alcohol, and 1 to 30 moles of propylene oxide per mole of coconut alcohol, the coconut alcohol fraction having from 10 to 14 carbon atoms, may also be employed. Such alkoxylated alcohols useful in the cleaning compositions hereof include PLURAFAC C17 surfactant by BASF, and DEIONIC 100 VLF by DeForest.

Alkoxylated alcohols which are sold as "Polytergent SL-series" surfactants by Olin Corporation or "Neodol" surfactants by Shell Chemical Co. are also so useful.

The polycarboxylated ethylene oxide condensates of fatty alcohols manufactured by Olin as "POLYTERGENT CS-1" are believed to be the most effective anionic surfactants. POLYTERGENT CS-1 in combination with the above POLYTERGENT SL-Series surfactants have been found particularly effective.

Effective surfactants which are nonionic alkoxylated alcohols and which also provide antifoam properties include POLYTERGENT SLF-18, also manufactured by Olin and "SURFONIC LF37" by Texaco.

When utilized for removing flux residues from electronic circuit assemblies, the cleaning composition of the present invention may also include an alkali metal silicate for the purpose of providing improved anti-corrosion protection as well as to ensure bright solder joints, connecting tabs and the like in such assemblies. For this purpose any of the sodium, potassium or lithium silicates may be utilized. Preferably, however, the sodium and potassium salts are utilized and, most preferably, potassium silicate is used. The alkali metal silicates which may be so employed are characterized by the general formula $M_2O:SiO_2$ wherein M represents the alkali metal and in which the ratio of the two oxides can vary. Most useful alkali metal silicates will have an $N_2O$ to $SiO_2$ mole ratio of between 1:0.5 and 1:4.5. Most preferably, the $M_2O$ to $SiO_2$ ratio is between 1:1.6 and 1:4.0. Such silicates also impart additional alkalinity to the ultimate aqueous cleaning solution.

An antifoaming agent may also be included in the cleaning composition of this invention. The antifoam agent is utilized to prevent the formation of excessive foam upon compounding of the cleaning concentrate or solution. It is important that the antifoaming agent, if used, does not act by placing a residual surface film on the article being cleaned. The antifoaming agent may be an agent which solely acts to inhibit foam or it may be a surfactant which helps to clean and emulsify soils such as the nonionic POLYTERGENT SLF-18 or SURFONIC LF37.

C. The Aqueous (Diluted) Cleaning Solution

The diluted, aqueous cleaning solutions which are employed by the ultimate user usually contain about 1% to 20 or greater wt. %, preferably about 3 to 15 wt. % and, most desirably, about 5 to 10 wt. % of the cleaning concentrate, with the balance being essentially water. The upper limit of concentration of the cleaning solution is not critical and is determined by the particular articles to be cleaned, the residues thereon and the conditions of treatment.

EXAMPLES

The following examples illustrate preferred forms of the cleaning compositions, concentrates and solutions, and cleaning methods of the present invention. In the examples, unless otherwise indicated, all parts and percentages are given by weight, and all temperatures are in degrees Fahrenheit. Reference to the "cleaning composition" below pertains to the mixtures of active materials including the surfactant component of components, the hydrotrope for the N-alkyl-2-pyrrolidone surfactant and the alkaline salt cleaning agent. The "concentrate" refers to the aqueous formulation containing the cleaning composition, with the percentages indicated being specified as the wt. % of the respective ingredients, based on the weight of the active materials (whether admixed in pure form or in solution). Lastly, the diluted cleaning solution (or the solution "as used") refers to the aqueous solution of the concentrate as diluted ten fold or otherwise for use by the consumer.

Concentrate Compositions

Table 1 identifies the ingredients in each test concentrate. The PLURAFAC, PLURONIC, SURFADONE and DEIONIC ingredients are surfactants, as indicated above. ("EO/PO" refers to the ethoxylated/propoxylated nonionic surfactants marketed as the PLURONIC ingredients specified.)

In preparing the formulation, the order of addition was as follows: water, potassium carbonate, alkoxy alcohols, ethoxylated/propoxylated nonionic surfactants, N-octyl pyrrolidone and the sodium capryl sulfonate or other hydrotrope. As noted above, all ingredients were added in an amount equal to a 100% actives level, e.g., the 5.0% sodium xylene sulfonate content in concentrate B was based on the addition of 12.5% of the 40% solution thereof to the concentrate.

As can be seen from Table 1, test samples C–C4, G, H, I–I4, J–J4, L–L5, Cb, Cb2, Cb3, Cc, Cc2 and Cc3 are examples of the cleaning concentrates of the invention:

TABLE 1

CONCENTRATE FORMULATIONS[1]

| Ingredient | | | A | B | C | D | E | F | G | H | I | J | K |
|---|---|---|---|---|---|---|---|---|---|---|---|---|---|
| Potassium Carbonate | | | 6.0% | 6.0% | 6.0% | 6.0% | 6.0% | 6.0% | 6.0% | 6.0% | 6.0% | 6.0% | 6.0% |
| Potassium Bicarbonate | | | | | | | | | | | | | |
| Plurafac C 17 (cp = 180) | BASF | Alkoxy alochol | 0.5 | 0.5 | 0.5 | 0.5 | 0.5 | 0.5 | 0.5 | 0.5 | 0.5 | 0.5 | 0.5 |
| Pluronic P84 (cp = 135) | BASF | EO/PO Nonionic | 0.5 | 0.5 | 0.5 | 0.5 | 0.5 | 0.5 | 0.5 | 0.5 | 0.5 | 0.5 | 0.5 |
| Pluronic P-85 (cp = 150) | BASF | EO/PO Nonionic | 1.0 | 1.0 | 1.0 | 1.0 | 1.0 | 1.0 | 1.0 | 1.0 | 1.0 | 1.0 | 1.0 |
| Surfadone LP-100 | ISP | Octyl Pyrrolidone | 3.0% | 3.0% | 3.0% | 3.0% | 3.0% | 3.0% | 3.0% | 3.0% | 5.0% | 10.0% | |
| Deionic 100 VLF | DeForest | Alkoxy alochol | | | | | | | | | | | |
| Detrope SA45 | DeForest | alkanoate (45%) | 5.0% | | | | | | 2.5% | | | | |
| Na Xylene Sulfonate | | (40%) | | 5.0% | | | | | | 2.5% | | | |
| Na Capryl Sulfonate | | (37.8%) | | | 5.0% | | | | 2.% | 2.% | 5.0% | 15.0% | |
| Deterg LF-531 | Deforest | (54%) | | | | 5.0% | | | | | | | |
| Triton H-66 | Union Carbide | | | | | | 5.0% | | | | | | |
| Triton H-55 | Union Carbide | | | | | | | 5.0% | | | | | |
| Physical Properties | Target | Range | | | | | | | | | | | |
| pH Concentrate | 11.6 | 11.5–11.7 | 11.77 | 11.72 | 11.42 | 10.73 | 11.32 | 10.84 | 11.60 | 11.59 | 11.40 | 11.33 | 11.89 |
| pH 10% usage | 11.2 | 11.1–11.3 | 11.28 | 11.10 | 11.00 | 10.67 | 11.11 | 10.58 | 11.22 | 11.25 | 11.10 | 11.06 | |
| pH 5% usage | 11.0 | 10.9–11.1 | | | | | | | | | | | |
| pH 3% usage | | | | | | | | | | | | | |

| Ingredient | | | C | C2 | C3 | C4 | I | I2 | I3 | I4 | J2* | J3* | J4* |
|---|---|---|---|---|---|---|---|---|---|---|---|---|---|
| Potassium Carbonate | | | 6.0% | 6.0% | 6.0% | 6.0% | 6.0% | 6.0% | 6.0% | 6.0% | 6.0% | 6.0% | 6.0% |
| Potassium Bicarbonate | | | | | | | | | | | | | |
| Plurafac C 17 (cp = 180) | BASF | Alkoxy alochol | 0.5 | 0.5 | 0.5 | 0.5 | 0.5 | 0.5 | 0.5 | 0.5 | 0.5 | 0.5 | 0.5 |
| Pluronic P84 (cp = 135) | BASF | EO/PO Nonionic | 0.5 | 0.5 | 0.5 | 0.5 | 0.5 | 0.5 | 0.5 | 0.5 | 0.5 | 0.5 | 0.5 |

TABLE 1-continued

CONCENTRATE FORMULATIONS[1]

| | | | | | | | | | | | | | |
|---|---|---|---|---|---|---|---|---|---|---|---|---|---|
| Pluronic P-85 (cp = 150) | BASF | EO/PO Nonionic | 1.0 | 1.0 | 1.0 | 1.0 | 1.0 | 1.0 | 1.0 | 1.0 | 1.0 | 1.0 | 1.0 |
| Surfadone LP-100 | ISP | Octyl Pyrrolidone | 3.0% | 3.0% | 3.0% | 3.0% | 5.0% | 5.0% | 5.0% | 5.0% | 10.0% | 10.0% | 10.0% |
| Deionic 100 VLF | DeForest | Alkoxy alcohol | | | | | | | | | | | |
| Bioterge PAS-8S | | Na Capryl Sulfonate (37.8%) | 5.0% | 4.0% | 3.0% | 4.5% | 5.0% | 7.0% | 6.0% | 6.5% | 13.0% | 10.0% | 10.5% |
| Physical Properties | Target | Range | | | | | | | | | | | |
| pH Concentrate | 11.6 | 11.5–11.7 | 11.42 | 11.48 | 11.55 | 11.53 | 11.40 | 11.37 | 11.39 | 11.38 | 11.32 | 11.38 | 11.30 |
| pH 10% usage | 11.2 | 11.1–11.3 | 11.00 | 11.14 | 11.17 | 11.15 | 11.10 | 11.08 | 11.04 | 11.10 | 10.99 | 11.11 | 11.05 |
| pH 5% usage | 11.0 | 10.9–11.1 | | | | | | | | | | | |
| pH 3% usage | | | | | | | | | | | | | |

| Ingredient | L* | L2* | L3 | L4 | L5 | M | M2 | M3 | M4 | M5 | N | N2 | N3 | N4* |
|---|---|---|---|---|---|---|---|---|---|---|---|---|---|---|
| Potassium Carbonate | 6.0% | 6.0% | 6.0% | 6.0% | 6.0% | 6.0% | 6.0% | 6.0% | 6.0% | 6.0% | 6.0% | 6.0% | 6.0% | 6.0% |
| Potassium Bicarbonate | | | | | | | | | | | | | | |
| Plurafac C 17 (cp = 180) | | | | | | | | | | | | | | |
| Pluronic P84 (cp = 135) | | | | | | | | | | | | | | |
| Pluronic P-85 (cp = 150) | | | | | | | | | | | | | | |
| Surfadone LP-100 | 3.0% | 3.0% | 3.0% | 3.0% | 3.0% | 3.0% | 3.0% | 3.0% | 3.0% | 3.0% | 3.0% | 3.0% | 3.0% | 3.0% |
| Deionic 100 VLF | | | | | | | | | | | | | | |
| Detrope SA45 | | | | | | 5.0% | 8.0% | 10.0% | 15.0% | 13.0% | | | | |
| Na Xylene Sulfonate | | | | | | | | | | | 15.0% | 19.0% | 21.0% | 25.0% |
| Bioterge PAS 8S | 15.0% | 11.0% | 8.0% | 5.0% | 6.5% | | | | | | | | | |
| Physical Properties | | | | | | | | | | | | | | |
| pH Concentrate | 11.32 | 11.38 | 11.30 | 11.43 | 11.37 | 11.82 | 11.82 | 11.75 | 11.78 | 11.77 | 11.84 | 11.52 | 11.52 | 11.50 |
| pH 10% usage | 11.08 | 11.22 | 11.00 | 11.10 | 11.11 | 11.27 | 11.21 | 11.21 | 11.26 | 11.20 | 11.29 | 11.13 | 11.04 | 11.12 |
| pH 5% usage | | | | | | | | | | | | | | *not |
| pH 3% usage | | | | | | | | | | | | | | clear |

| Ingredient | | | Ab | Ab2 | Ab3 | Ab4 | Ab5 | Ab6 | Cb | Cb2 | Cb3 |
|---|---|---|---|---|---|---|---|---|---|---|---|
| Potassium Carbonate | | | 6.0% | 6.0% | 6.0% | 6.0% | 6.0% | 6.0% | 6.0% | 6.0% | 6.0% |
| Potassium Bicarbonate | | | | | | | | | | | |
| Plurafac C 17 (cp = 180) | BASF | Alkoxy alcohol | 0.5 | 0.5 | 0.5 | 0.5 | 0.5 | 0.5 | 0.5 | 0.5 | 0.5 |
| Pluronic P84 (cp = 135) | BASF | EO/PO Nonionic | 0.5 | 0.5 | 0.5 | 0.5 | 0.5 | 0.5 | 0.5 | 0.5 | 0.5 |
| Pluronic P-85 (cp = 150) | BASF | EO/PO Nonionic | 1.0 | 1.0 | 1.0 | 1.0 | 1.0 | 1.0 | 1.0 | 1.0 | 1.0 |
| Surfadone LP-300 | ISP | Dodectyl Pyrrolidone | 3.0% | 3.0% | 3.0% | 3.0% | 3.0% | 3.0% | 3.0% | 3.0% | 3.0% |
| Detrope SA45 | DeForest | alkanoate (45%) | 5.0% | 10.0% | 15.0% | 17.0% | 21.0% | 19.0% | | | |
| Bioterge PAS-8S | | Na Capryl Sulfonate (37.8%) | | | | | | | 5.0% | 10.0% | 7.5% |
| Physical Properties | Target | Range | | | | | | | | | |
| pH Concentrate | 11.6 | 11.5–11.7 | 11.43 | 11.29* | 11.45^ | 11.46^ | 11.35^ | 11.39^ | 11.27 | 11.29* | 11.31 |
| pH 10% usage | 11.2 | 11.1–11.3 | 11.08 | 11.01 | 11.19 | 11.00 | 11.03 | 11.17 | 11.00 | 11.00 | 11.04 |
| pH 5% usage | 11.0 | 10.9–11.1 | | | | | | | | | |
| pH 3% usage | | | | | | | | | | | |

| Ingredient | | | Ac | Ac2 | Ac3 | Ac4 | Cc | Cc2 | Cc3 |
|---|---|---|---|---|---|---|---|---|---|
| Potassium Carbonate | | | 6.0% | 6.0% | 6.0% | 6.0% | 6.0% | 6.0% | 6.0% |
| Potassium Bicarbonate | | | | | | | | | |
| Plurafac C 17 (cp = 180) | BASF | Alkoxy alcohol | | | | | | | |
| Pluronic P84 (cp = 135) | BASF | EO/PO Nonionic | | | | | | | |
| Pluronic P-85 (cp = 150) | BASF | EO/PO Nonionic | | | | | | | |
| Surfadone LP-300 | ISP | Dodecyl Pyrrolidone | 3.0% | 3.0% | 3.0% | 3.0% | 3.0% | 3.0% | 3.0% |
| Detrope SA45 | DeForest | alkanoate (45%) | 25.0% | 10.0% | 15.0% | 20.0% | | | |
| Bioterge PAS-8S | | Na Capryl Sulfonate (37.8%) | | | | | 10.0% | 15.0% | 13.0% |
| Physical Properties | Target | Range | | | | | | | |
| pH Concentrate | 11.6 | 11.5–11.7 | 11.35^ | 11.35^ | 11.39^ | 11.27^ | 11.24 | 11.40* | 11.33* |
| pH 10% usage | 11.2 | 11.1–11.3 | 11.03 | 11.00 | 10.98 | 10.94 | 11.00 | 11.13 | 11.00 |
| pH 5% usage | 11.0 | 10.9–11.1 | | | | | | | |
| pH 3% usage | | | | | | | | | |

*KOH was added to increase the pH.
^ HCl was added to decrease the pH.
[1]All n %s in the concentrates are expressed in terms of 100% of each active ingredient.

Hydrotrope Stability Studies

Table 2 and Table 3 set forth the results of hydrotrope studies which utilized the N-octyl pyrrolidone and N-dodecyl pyrrolidone-containing concentrates of Table 1. Here, the stabilities of the concentrates were measured and recorded. The concentrates were tested for stability using three criteria—the Ensure Freeze-Thaw Stability Test, the Increased Temperature at 122° F. Test and the Room Temperature Test.

The Ensure Freeze-Thaw Stability Test involves freezing the concentrate overnight at 0° F. followed by thawing to room temperature. The concentrate is then visually observed for layering or separation of the formula After the initial observation, the concentrate is shaken for 30 seconds and observed to see if the chemicals go back into solution. Both visual observations are recorded.

The protocols for the Increased Temperature Test and the Room Temperature Test are the same as for the Ensure Freeze-Thaw Stability Test procedure, except that these tests do not require the concentrates to be shaken after initial observation. Moreover, observations for these tests are done immediately at the specific test temperature.

The term "clear, no separation" in Table 2 and Table 3 refers to the amount of hydrotrope added to the concentrate for it to be clear; those amounts are indicated in Tables 5–9 and FIGS. 1–5 discussed below.

Table 2 and Table 3 also refer to a 120° F. and 150° F. "Stability Test for 10%". The term 10% refers to the diluted solution containing 10% of the test concentrate. The 10% solutions were tested for stability, too. Each solution was heated to 120° F. and visually observed under a high intensity halogen lamp with a black background. After observation, the solution was then heated to 150° F. and observed in the same manner. The solution was then cooled to room temperature and observed in the same manner.

A foam test was also performed on test samples C, C4, I3, I4 and J. The foam test procedure involved placing 40 mL of a 10% solution of concentrated formula into a 100 mL-graduated cylinder and heating the solution to desired temperature in a water bath. After reaching the desired temperature, the solution was shaken for 30 seconds. The height of the foam was observed and recorded. Immediately after shaking, a timer was started and readings were taken every minute after shaking for 30 seconds for 5 minutes. After the readings were collected, 40 mL was subtracted from the readings to account for the initial amount of solution.

The quantitative data obtained in the foam test are recorded in Table 4 below:

TABLE 2

N-OCTYL PYRROLIDONE HYDROTROPING STUDY

| Formula ♠ | pH | Freeze-Thaw Stability | Increased Temp (122 F) | Room Temperature | 120 F. Stability Test for 10% | 150 F. Stability Test for 10% | Foam Test |
|---|---|---|---|---|---|---|---|
| A | 11.77 | clear visible striation on top, goes back into solution after shaking | clear, no separation | clear, no separation | | | |
| 10% of A | 11.28 | | | | slightly cloudy, slight separation (cloudy layers) | slightly cloudy, separation (particles) | N/A |
| B | 11.72 | cloudy layer on btm, clear striation on top, goes back into soln after shaking | clear, no separation | clear, no separation | | | |
| 10% of B | 11.10 | | | | cloudy, separation (cloudy layers and particles) | slighty cloudy, separation (particles and cloudy layers) | N/A |
| C | 11.42 | clear visible striation, goes back into solution after shaking | clear, no separation | clear, no separation | | | |
| 10% of C | 11.00 | | | | clear, no separation | clear, no separation | yes |
| C2 | 11.48 | cloudy layer on btm, goes back into soln after shaking | clear, no separation | clear, no separation | | | |
| 10% of C2 | 11.14 | | | | clear, no separation | cloudy, separation (cloudy layers and particles) | N/A |
| C3 | 11.55 | cloudy layer between 2 clear layers, goes back into soln after shaking | clear, no separation | slightly cloudy, no separation | | | |
| 10% of C3 | 11.17 | | | | clear, no separation | slightly cloudy, separation (particles) | N/A |
| C4 | 11.53 | slightly cloudy layer at btm, clear visible striation at top, goes back into soln after shaking | clear, no separation | clear, no separation | | | |
| 10% of C4 | 11.15 | | | | clear, no separation | clear, no separation | yes |
| D | 10.73 | yellow tinted layer on top, clear visible layer on btm, goes back into soln after shaking | cloudy, no separation | clear, no separation | | | |
| 10% of D | 10.67 | | | | cloudy, separation (particles) | slightly cloudy, separation, layer at top and particles | N/A |
| E | 11.32 | clear visible striation on top, goes back into solution after shaking | clear, no separation | clear, no separation, filming occurred on bottle | | | |

TABLE 2-continued

N-OCTYL PYRROLIDONE HYDROTROPING STUDY

| Formula | pH | Freeze-Thaw Stability | Increased Temp (122 F) | Room Temperature | 120 F. Stability Test for 10% | 150 F. Stability Test for 10% | Foam Test |
|---|---|---|---|---|---|---|---|
| 10% of E | 11.11 | | | | cloudy, separation (cloudy layers and particles) | cloudy, separation (particles) | N/A |
| F* | 10.84 | cloudy layer on btm, goes back into soln after shaking | clear with visible layer on top, after shaking turns cloudy | clear, no separation, filming occurred on bottle | | | |
| 10% of F | 10.58 | | | | cloudy, separation (particles) | cloudy, separation (particles) | N/A |
| F2 (added KOH) | 11.30 | N/A | N/A | clear, no separation | | | |
| 10% of F 2 | 11.06 | | | | cloudy, separation (particles) | cloudy, separation (particles) | N/A |
| G | 11.60 | clear visible striation on top, goes back into solution after shaking | clear, no separation | clear, no separation | | | |
| 10% of G | 11.22 | | | | clear, no separation | cloudy, separation (particles) | N/A |
| H | 11.59 | cloudy layer on btm, clear visible striation on top, goes back into soln after shaking | clear, no separation | clear, no separation | | | |
| 10% of H | 11.25 | | | | clear, no separation | cloudy, separation (particles) | N/A |
| I | 11.40 | cloudy layer between 2 clear layers, goes back into soln after shaking | clear, no separation | clear, no separation | | | |
| 10% of I | 11.10 | | | | clear, no separation | cloudy, separation (cloudy layers and particles) | N/A |
| I2 (7.0%) | 11.37 | clear visible striation at top, goes back into soln after shaking | clear, no separation | clear, no separation | | | |
| 10% of I 2 | 11.08 | | | | clear, no separation | clear, no separation | N/A |
| I3 (6.0%) | 11.39 | cloudy layer between 2 clear layers and clear visible striation on top, goes back into soln after shaking | clear, no separation | clear, no separation | | | |
| 10% of I 3 | 11.04 | | | | clear, no separation | clear, no separation | yes |
| I4 (6.5%) | 11.38 | slightly cloudy layer on btm, clear visible striation on top, goes back into soln after shaking | clear, no separation | clear, no separation | | | |
| 10% of I 4 | 11.10 | | | | clear, no separation | clear, no separation | |
| J (added KOH) | 11.33 | clear visible striation on top, goes back into soln after shaking | clear, no separation | clear, no separation | | | |
| 10% of J | 11.06 | | | | clear, no separation | clear, no separation | yes |
| J2 (added KOH) | 11.32 | clear visible striation on top, goes back into soln after shaking, very thick | clear, no separation | clear, no separation | | | |
| 10% of J | 10.99 | | | | clear, no separation | clear, no separation | N/A |
| J3 (added KOH) | 11.38 | clear visible striation on top, goes back into soln after shaking | clear, no separation | clear, no separation | | | |
| 10% of J $3^2$ | 11.11 | | | | clear, no separation | clear, no separation | N/A |
| J4 (added KOH) | 11.30 | clear visible striation on top, goes back into soln after shaking | clear, no separation | clear, no separation | | | |
| 10% of J 4 | 11.05 | | | | clear, no separation | clear, no separation | N/A |
| K | 11.89 | cloudy layer on btm, clear visible striation on top, goes back into soln | clear, separation, white particles on top and floating though soln, becomes cloudy when shaken | clear, no separation | | | N/A |
| L (added | 11.32 | Clear visible striation | clear, no separation | clear, no separation | | | |

TABLE 2-continued

N-OCTYL PYRROLIDONE HYDROTROPING STUDY

| Formula ♠ | pH | Freeze-Thaw Stability | Increased Temp (122 F) | Room Temperature | 120 F. Stability Test for 10% | 150 F. Stability Test for 10% | Foam Test |
|---|---|---|---|---|---|---|---|
| KOH) | | on top, goes back into soln after shaking | | | | | |
| 10% of L | 11.08 | | | | clear, no separation | clear, no separation | N/A |
| L2 (added KOH) | 11.38 | Clear visible striation on top, goes back into soln after shaking | clear, no separation | clear, no separation | | | |
| 10% of L 2 | 11.22 | | | | clear, no separation | clear, no separation | N/A |
| L3 | 11.30 | Clear visible striation on top, goes back into soln after shaking | clear, no separation | clear, no separation | | | |
| 10% of L 3 | 11.00 | | | | clear, no separation | clear, no separation | N/A |
| L4 | 11.43 | N/A | N/A | clear, no separation | | | |
| 10% of L 4 | 11.10 | | | | cloudy, separation, cloudy layer | cloudy, separation small particles and cloudy layer | N/A |
| L5 | 11.37 | N/A | N/A | clear, no separation | | | |
| 10% of L 5 | 11.11 | | | | slightly cloudy, no separation | cloudy, separation cloudy layer | N/A |
| M | 11.82 | N/A | N/A | clear, no separation | | | |
| 10% of M, clear | 11.27 | | | | slightly cloudy, separation small & large particles | slightly cloudy, separation few large particles forming on surface | N/A |
| M2 | 11.82 | N/A | N/A | clear, no separation | | | |
| 10% of M 2 slightly cloudy | 11.21 | | | | slightly cloudy, separation small particles | slightly cloudy, separation small & large particles on surface and throughout | N/A |
| M3 | 11.75 | N/A | N/A | clear, no separation | | | |
| 10% of M 3 clear | 11.21 | | | | cloudy, separation particles | slightly cloudy, separation particles | N/A |
| M4 | 11.78 | Slight clear visible striation on top, goes back into soln after shaking | Clear, no separation | clear, no separation | | | |
| 10% of M 4 clear | 11.26 | | | | clear, no separation | clear, no separation | N/A |
| M5 | 11.77 | N/A | N/A | clear, no separation | | | |
| 10% of M 5 clear | 11.20 | | | | clear, no separation | | |
| N | 11.84 | N/A | N/A | clear, no separation | | | |
| 10% of N cloudy | 11.29 | | | | slightly cloudy, separation small particles | clear, separation small & large particles | N/A |
| N2 | 11.52 | N/A | N/A | clear, no separation | | | |
| 10% of N 2 | 11.13 | | | | slightly cloudy, separation small & large particles | clear, separation large particles | N/A |
| N3 | 11.52 | N/A | N/A | clear, no separation | | | |
| 10% of N 3 | 11.04 | | | | slightly cloudy, separation small particles | slightly cloudy, separation small particles | N/A |
| N4 | 11.50 | N/A | N/A | clear, no separation | | | |
| 10% of N 4 | 11.12 | | | | cloudy, separation small particles | clear, separation small & large particles | N/A |

♠ See Table 1 for specific conecntrate formulas.

*Added 13.57% of Triton H-55 to the formula for it to be clear.

ˆ During foam test, the soln turned slightly cloudy.

[2]When the 10% solution of "J3" was cooled from 150° F., the solution was clear, but had a slight cloudy layer on the surface.

TABLE 3

N-DODECYL PYRROLIDONE HYDROTROPING STUDY

| Formula ♠ | pH of Neat | pH of 10% | Freeze-Thaw | 122° F. Stability | RT Stability | 120° F. Stability with 10% dilution | 150° F. Stability with 10% dilution |
|---|---|---|---|---|---|---|---|
| Ab | 11.43 | 11.08 | Clear visible striation on top, goes back into soln after shaking | Clear, no separation | Clear, no separation | cloudy, separation particles | Slightly cloudy, separation, particles & oily surface |
| Ab2 | 11.29* | 11.01 | Clear visible striation on top, goes back into soln after shaking | Clear, no separation | Clear, no separation | Cloudy, separation, cloudy layers | Slightly cloudy, separation, particles & oily surface |
| Ab3 | 11.45^ | 11.19 | Clear visible striation on top, goes back into soln after shaking | Clear, no separation | Clear, no separation | Slightly cloudy, no separation | Cloudy, separation cloudy layers |
| Ab4 | 11.50^ | 11.00 | Clear visible striatoin on top, goes back into soln after shaking | Clear, no separation | Clear, no separation | Slightly cloudy, no separation | Cloudy, separation, cloudy layers |
| Ab5 | 11.35^ | 11.03 | Clear visible striation on top, goes back into soln after shaking | Clear, no separation | Clear, no separation | Clear, no separation | Clear, no separation |
| Ab6 | 11.39^ | 11.17 | Clear visible striation on top, goes back into soln after shaking | Clear, no separation | Clear, no separation | Clear, no separation | Cloudy, separation, cloudy layers |
| Cb | 11.27 | 11.00 | Clear visible striation on top, goes back into soln after shaking | Clear, no separation | Clear, no separation | Slightly cloudy, no separation | Slightly cloudy, separation, particles & cloudy layers |
| Cb2 | 11.29* | 11.00 | Clear visible striation on top, goes back into soln after shaking | Clear, no separation | Clear, no separation | Slightly cloudy, no separation | Slightly cloudy, no separation |
| Cb3 | 11.31 | 11.04 | Clear visible striation on top, goes back into soln after shaking | Clear, no separation | Clear, no separation | Slightly cloudy, no separation | Slightly cloudy, no separation |
| Ac | 11.35^ | 11.03 | clear visible striation, goes back into soln after shaking, very thick soln | clear, no separation | clear, no separation | slightly cloudy, no separation | slightly cloudy, separation, cloudy layers |
| Ac2 | 11.35^ | 11.00 | clear visisble striation, goes back into soln after shaking | clear, no separation | clear, no separation | cloudy, separation, cloudy layers & particles | cloudy, separation, particles |
| Ac3 | 11.39^ | 10.98 | clear visible striation, goes back into soln after shaking | clear, no separation | clear, no separation | slightly cloudy, separation, cloudy layers | slightly cloudy, separation, particles |
| Ac4 | 11.27^ | 10.94 | clear visible striation, goes back into soln after shaking | clear, no separation | clear, no separation | slightly cloudy, no separation | slightly cloudy, separation, cloudy layers |
| Cc | 11.24 | 11.00 | clear visible striation, goes back into soln after shaking | clear, no separtion | clear, no separation | slightly cloudy, no separation | slightly cloudy, separation, cloudy layers |
| Cc2 | 11.40* | 11.13 | clear visible striation, goes back into soln after shaking | clear, no separation | clear, no separation | slightly cloudy, no separation | slightly cloudy, no separation |
| Cc3 | 11.33* | 11.00 | clear visible striation, goes back into soln after shaking | clear, no separation | clear, no separation | slightly cloudy, no separation | slightly cloudy, no separation |

♠ See Table 1 for specific concentrate formulas.
*KOH added to the Neat Product to increase the Ph.
^ HCl added to the Neat Product to decrease the pH.

TABLE 4

N-OCTYL PYRROLIDONE HYDROTROPE FOAM TEST

| Formula | temperature | 30 seconds | 1 minute | 2 minutes | 3 minutes | 4 minutes | 5 minutes |
|---|---|---|---|---|---|---|---|
| C 10% | 120° F. | 60 + mL | 60 + mL | 60 + mL | 60 mL | 50 mL | 40 mL |
| | 150° F. | 60+ | 60 | 12 | 2 | 0 | 0 |
| C4 10% | 120° F. | 60+ | 25 | 5 | 0 | 0 | 0 |
| | 150° F. | 60+ | 8 | 0 | 0 | 0 | 0 |
| I3 10% | 120° F. | 60+ | 60 | 20 | 6 | 3 | 0 |
| | 150° F. | 60+ | 0 | 0 | 0 | 0 | 0 |
| I4 10% | 120° F. | 60+ | 60+ | 60+ | 60 | 52 | 40 |
| | 150° F. | 60+ | 60 | 15 | 2 | 0 | 0 |
| J 10% | 120° F. | 60+ | 60+ | 60+ | 60+ | 60 | 50 |
| | 150° F. | 60+ | 60+ | 33 | 8 | 2 | 0 |

Based on the hydrotrope studies shown above, it is clear that the concentrates of the claimed invention surpass the other test samples in stability and defoaming characteristics. Table 2 shows the superior stability of test samples C–$C_4$, G, H, I–I4, J–J4 and L–L5 under the various test conditions and Table 3 also shows very good stability of test samples Cb, Cb2, Cb3, Cc, Cc2 and Cc3 under various test conditions. Similarly, Table 4 shows the excellent defoaming qualities of the N-octyl pyrrolidone-containing test samples C, C, I3, I4 and J.

(Surfadone® LP 100) in the concentrated product or 0.30% active N-octyl pyrrolidone (Surfadone® LP 100) in the 10% aqueous systems.

Table 5 and FIG. 1 clearly demonstrate the sodium capryl sulfonate hydrotrope is vastly superior to either the alkanoate or sodium xylene sulfonate for effecting solubility of the N-octyl pyrrolidone in both the concentrated and diluted products. It should be noted that even 25% sodium xylene sulfonate was not sufficient to solubilize the 0.3% active N-octyl pyrrolidone in the dilute solutions.

TABLE 5

Amount of Hydrotrope Required to Solubilize a 3.0% Concentration Containing N-Octyl Pyrrolidone, Without Other Surfactants

| Formula | Bioterge PAS-8S Examples L–L4 | Detrope SA-45 Controls M–M4 | Na Xylene Sulfonate Controls N–N4 |
|---|---|---|---|
| Concentrate Clear (RT)[1] | 3.53% | 2.35% | 3.42% |
| Concentrate Stable (RT/0F/122F)[2] | 8.00% | 15.00% | 15.00% |
| Formulation of 10% LP 100 Concentrate 120° F. | 6.50% | 13.00% | 25.00% |
| Formulation of 10% LP 100 Concentrate 150° F. | 8.00% | 15.00% | 25.00% (Not Stable) |

[1]Clear Concentrate (RT) refers to the amount of hydrotrope added to the concentrate for it to be clear at room temperature only.
[2]Concentrate Stable refers to the amount of hydrotrope required to solubilize the concentrate at room temperature, freeze thaw (1 cycle) and 122° F. storage conditions.

Comparative Results

Table 5 below and FIG. 1 compare the relative efficacy of three different hydrotropes in solubilizing concentrates containing 3.0% of N-octyl pyrrolidone-(ISP's Surfadone® LP 100 where R=$CH_3(CH_2)_7$) without additional surfactant components, for four different conditions:

Clear Concentrate (RT) refers to the amount of hydrotrope added to the concentrate for the concentrate to be clear at room temperature only.

Stable Concentrate refers to the amount of hydrotrope required to solubilize the concentrate for room temperature, freeze thaw (1 cycle) and 122° F. storage conditions.

10%/120° F. refers to the solubility of the diluted cleaning solutions (as used), containing 10% of the concentrate at 120° F.

10%/150° F. refers to the solubility of cleaning composition containing 10% of concentrate at 150° F.

Each system contained 6.0% potassium carbonate/3.0% N-octyl pyrrolidone (3.0% Surfadone® LP 100)/X% hydrotrope. The hydrotropes compared were sodium capryl sulfonate hydrotrope (Stepan's BIO-TERGE PAS-8S), alkanoate (DeForest's Detrope SA45), and sodium xylene sulfonate (STEPANATE SXS). All hydrotrope concentrations are shown (i.e. X axis) at the 100% actives level. The percents shown on all figures are for the concentrate, and the 10% dilutions of the concentrate where indicated. For example, the 10% cleaning composition shown at 120° F. and 150° F. have concentrations that are reduced to $1/10^{th}$ the concentrate concentration. In FIG. 1, the hydrotropes were compared for their ability (i.e. the amount required) to solubilize 3% of 100% active N-octyl pyrrolidone Table 6 and FIG. 2 compare the relative efficacy of a sodium alkyl sulfonate and another hydrotrope in solubilizing concentrates containing 3.0 % of N-dodecyl pyrrolidone (ISP's Surfadone® LP 300 where R=$CH_3(CH_2)_{11}$) without additional surfactant components, for the same four conditions described above for FIG. 1 and Table 5.

Each system contained 6.0% potassium carbonate/3.0% N-dodecyl pyrrolidone (3.0% Surfadone® LP 300)/X% of the hydrotrope. The hydrotropes compared were sodium capryl sulfonate (Stepan's BIO-TERGE PAS-8S), and alkanoate (DeForest's Detrope SA45). All hydrotrope concentrations are shown at the 100% actives level. The percentages shown on all figures are for the concentrate, and the 10% dilutions of the concentrate where indicated. For example, the 10% cleaning composition shown at 120° F. and 150° F. have concentrations that are reduced to $1/10^{th}$ the concentrate concentration. In FIG. 2, the hydrotropes were compared for their ability (i.e., the amount required) to solubilize 3% of 100% active N-dodecyl pyrrolidone (Surfadone® LP 300) in the concentrated product or 0.30% active N-dodecyl pyrrolidone (Surfadone® LP 300) in the 10% aqueous systems.

Figure 2:
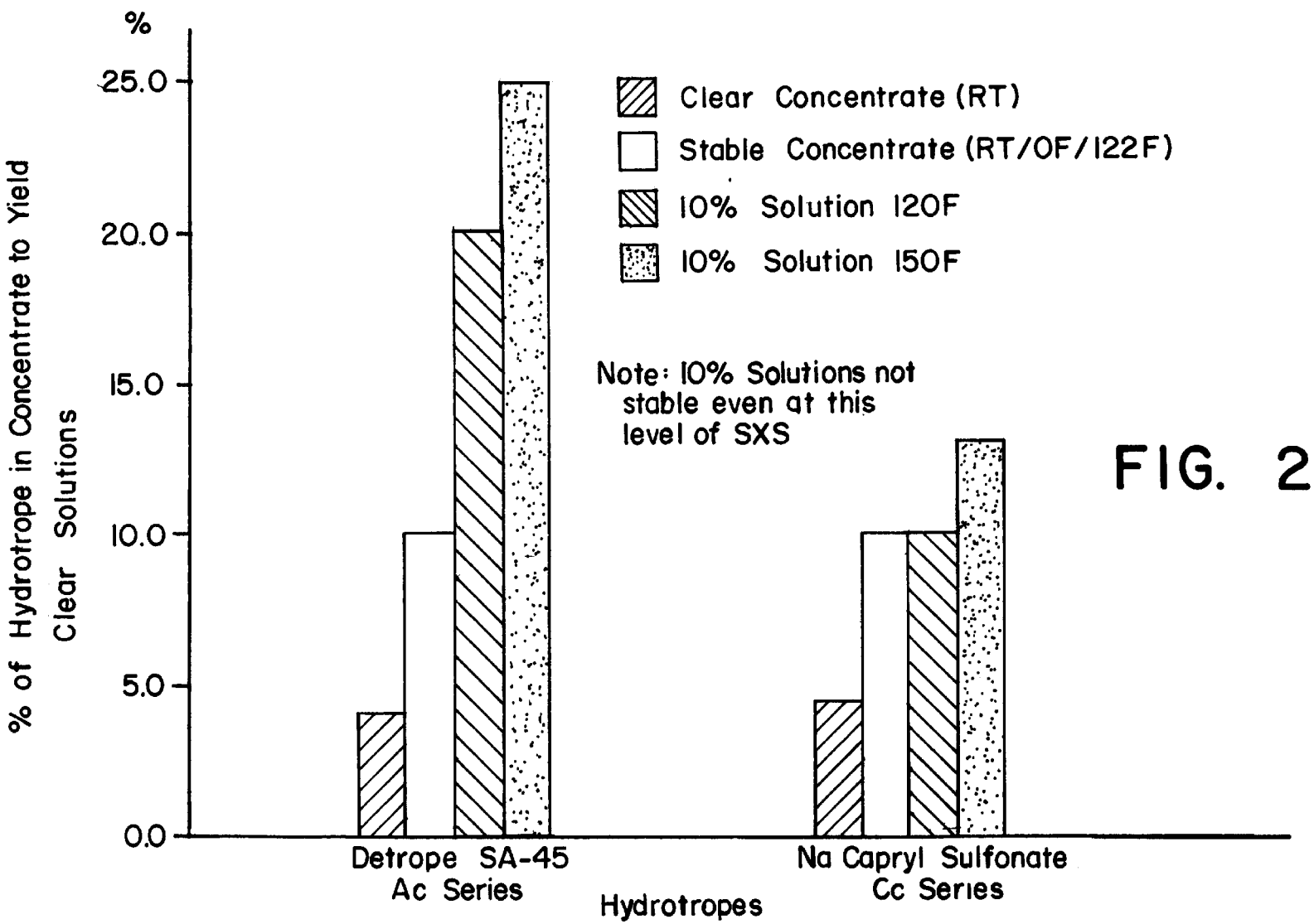
FIG. 2 is a graph illustrating the percentages of different hydrotropes required to solubilize N-dodectyl pyrrolidone (Surfadone® LP 300) in aqueous cleaning concentrates and 10% solutions, under different conditions.

Table 6 and FIG. 2 clearly demonstrate that the sodium capryl sulfonate hydrotrope is vastly superior to the alkanoate for solubilizing the N-dodecyl pyrrolidone in the diluted products. It should be noted that even 25% alkanoate was not sufficient to solubilize the 0.3% active N-dodecyl pyrrolidone (Surfadone® LP 300) in the dilute solutions.

TABLE 6

Amount of Hydrotrope Required To Solubilize Concentrate Containing 3% N-Dodecyl Pyrrolidone Without Other Surfactants

| Formula | Na Capryl Sulfonate Examples Cc–Cc3 | Detrope SA-45 Controls Ac–Ac4 |
|---|---|---|
| Concentrate Clear (RT)[1] | 4.39 | 4.18 |
| Concentrate Stable (RT/0F/122F)[2] | 10.00 | 10.00 |
| Formulation of 10% LP 300 Concentrate 120° F. | 10.00 | 20.00 |
| Formulation of 10% LP 300 Concentrate 150° F. | 13.00 | 25.00 (Not Stable) |

[1]Clear Concentrate (RT) refers to the amount of hydrotrope added to the concentrate for it to be clear at room temperature only.
[2]Concentrate Stable refers to the amount of hydrotrope required to solubilize the concentrate at room temperature, freeze thaw (1 cycle) and 122° F. storage conditions.

Figure 3:
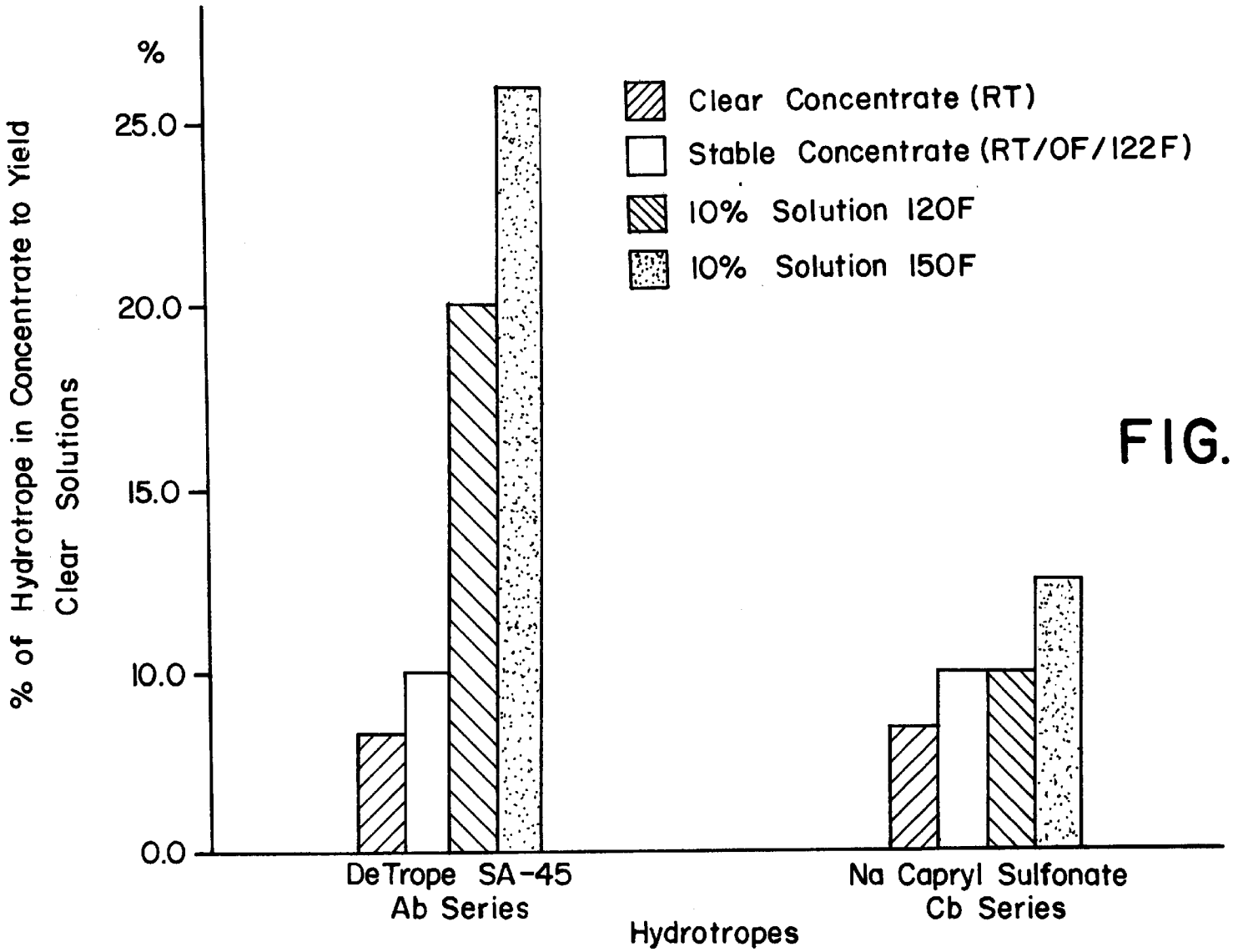
FIG. 3 is a graph illustrating the percentages of different hydrotropes required to solubilize N-dodectyl pyrrolidone (Surfadone® LP 300) with additional surfactants in aqueous cleaning concentrates and 10% solutions, under different conditions.

Table 7 and FIG. 3 compare the relative efficacy of two different hydrotropes in solubilizing concentrates containing 3% of N-dodecyl pyrrolidone and additional surfactant components for the same four conditions described above for FIG. 1 and Table 5.

Each system contained 6.0% potassium carbonate/3.0% N-dodecyl pyrrolidone/X% hydrotrope, as well as other surfactants which included alkoxyl alcohol and ethoxylated/propoxylated nonionic surfactants. The hydrotropes compared were sodium capryl sulfonate and alkanoate (DeForest's Detrope SA45). All hydrotrope concentrations are shown at the 100% actives level. The percentages shown on all figures are for the concentrate, and the 10% dilutions of the concentrate where indicated. For example, the 10% cleaning composition shown at 120° F. and 150° F. have concentrations that are reduced to $1/10^{th}$ the concentrate concentration. In FIG. 3, the hydrotropes were compared for their ability (i.e. the amount required) to solubilize 3% of 100% active N-dodecyl pyrrolidone and additional surfactant in the concentrated product or 0.30% active N-dodecyl pyrrolidone in the 10% aqueous systems.

Table 7 and FIG. 3 clearly demonstrate that the sodium capryl sulfonate hydrotrope is vastly superior to the alkanoate for solubilizing the N-dodecyl pyrrolidone in the diluted products.

TABLE 7

Amount of Hydrotrope Required to Solubilize Concentrate Containing 3% N-Dodecyl Pyrrolidone and Other Surfactants

| Formula | Na Capryl Sulfonate (Bioterge PAS-8S) Examples Cb–Cb3 | Detrope SA-45 Controls Ab–Ab6 |
|---|---|---|
| Concentrate Clear (RT)[1] | 3.48 | 3.30 |
| Concentrate Stable (RT/OF 122F)[2] | 5.00 | 5.00 |
| Formulation of 10% LP 300 Concentrate 120° F. | 5.00 | 15.00 |
| Formulation of 10% LP 300 Concentrate 150° F. | 7.50 | 21.00 |

[1]Clear Concentrate (RT) refers to the amount of hydrotrope added to the concentrate for it to be clear at room temperature only.
[2]Concentrate Stable refers to the amount of hydrotrope required to solubilize the concentrate at room temperature, freeze thaw (1 cycle) and 122° F. storage conditions.

Figure 4:
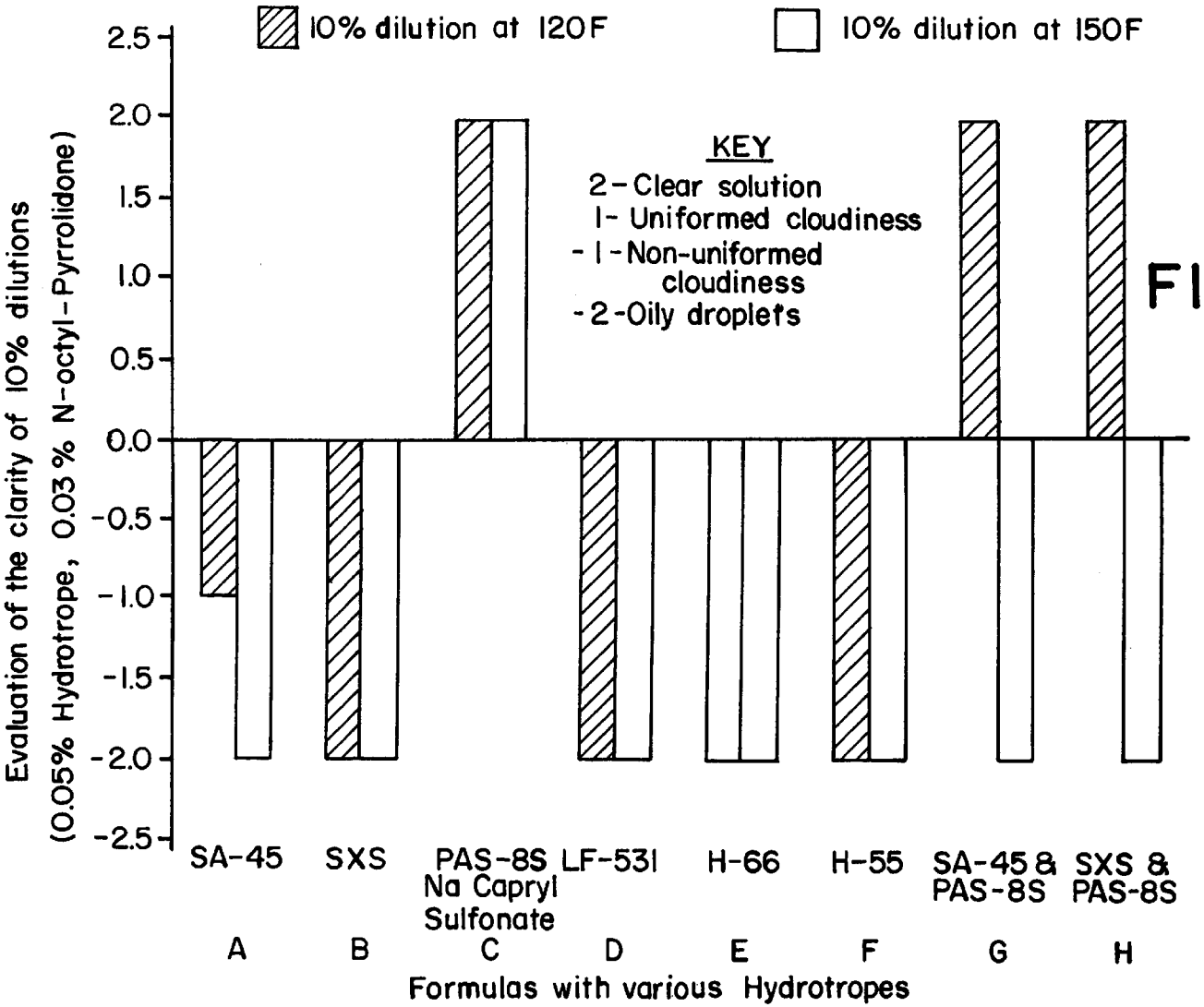
FIG. 4 is a graph illustrating the relative clarities of aqueous cleaning solutions containing a surfactant formulation incorporating N octyl pyrrolidone, and eight different hydrotropes and hydrotrope mixtures.

Table 8 and FIG. 4 compare the ability of a number of hydrotropes to solubilize 0.3% active N-octyl pyrrolidone in the diluted aqueous cleaning solutions, with the respective hydrotropes used at the same 0.5% actives level. Employing concentrates G and H (see Table 1), the hydrotrope system consisted of 50/50 combinations of sodium capryl sulfonate with the noted hydrotropes. The surfactant formulations of concentrates A–H also contained the surfactants 0.05% Plurafac C17/0.05% Pluronic P84 and 0.1% Pluronic P85 at the 10% aqueous dilution. From Table 8 and FIG. 4, it can easily be seen that concentrates C, G, and H, the sodium capryl sulfonate containing concentrates, are superior to the other concentrates.

TABLE 8

Ability of 5.0% of Various Hydrotropes to Solubilize 3% of N-octyl Pyrrolidone And Additional Surfactants

| Hydrotrope | 10% Dilution at 120° F. | 10% Dilution at 150° F. |
|---|---|---|
| A | −1 | −2 |
| B | −2 | −2 |
| C | 2 | 2 |
| D | −2 | −2 |
| E | −2 | −2 |
| F | −2 | −2 |
| G* | 2 | −2 |
| H^ | 2 | −2 |

Figure 5:
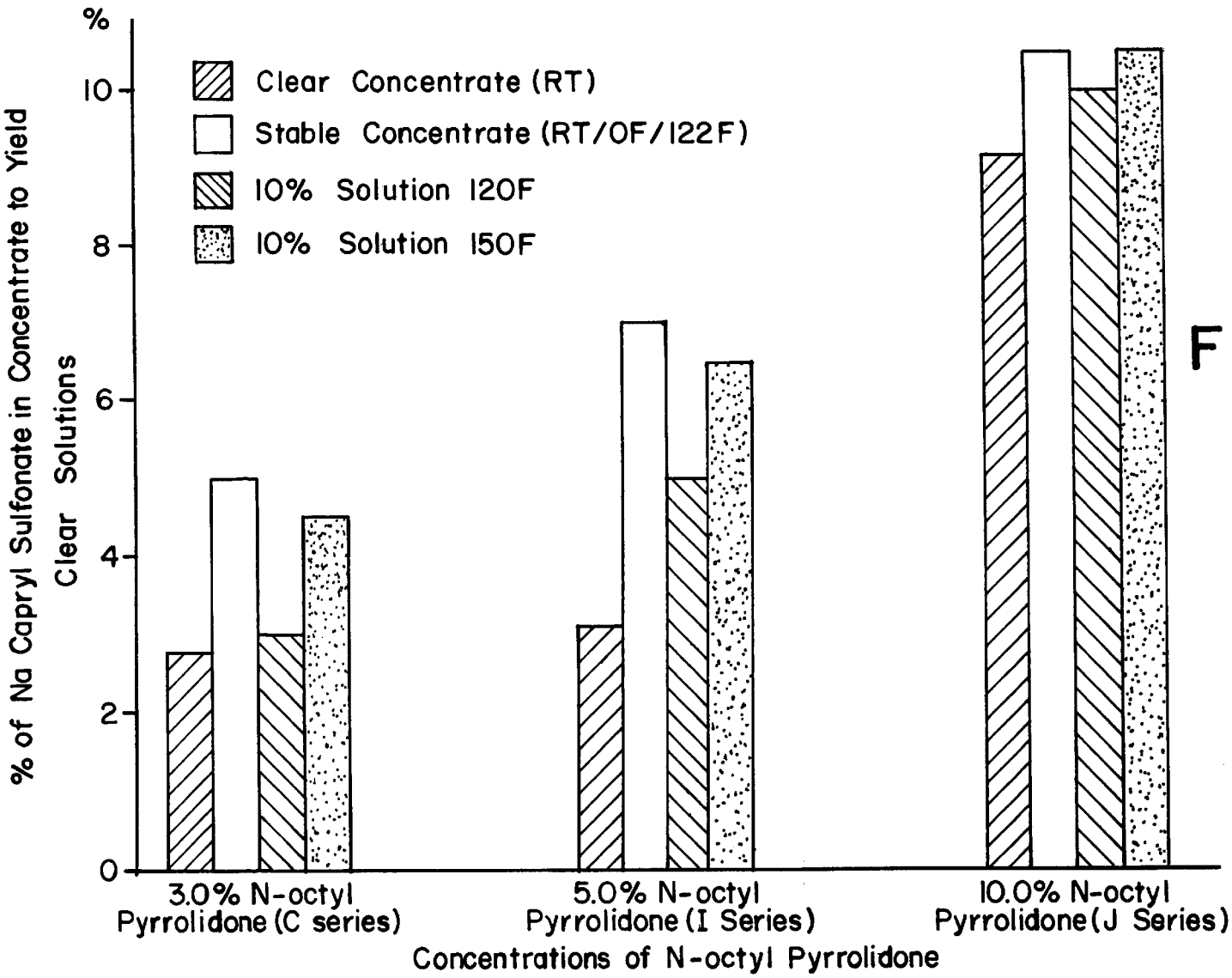
FIG. 5 is a graph illustrating the percentages of the sodium capryl sulfonate hydrotrope required to solubilize aqueous cleaning concentrates and solutions containing surfactant formulations incorporating differing percentages of N-octyl pyrrolidone.

Key:
2—clear solution
1—uniformed cloudiness
−1—non-uniformed cloudiness
−2—oily droplets
Note:
*Mixture of hydrotropes, 2.5% Na capryl sulfonate and 2.5% SA-45
^ Mixture of hydrotropes, 2.5 Na capryl sulfonate and 2.5% SXS Table 9 and FIG. 5 demonstrate the required amount of the sodium capryl sulfonate hydrotrope to solubilize various 100% active levels of N-octyl pyrrolidone. These concentrates also contained the surfactant combination described in connection with Table 8. The 100% active weight % ratios of sodium capryl sulfonate/N-octyl pyrrolidone required to achieve solubility are given in Table 9 below:

TABLE 9

Amount of Na Capryl Sulfonate Required to Solubilize Various Concentrations of N-Octyl Pyrrolidone (LP 100)-Containing Concentrate Containing Additional Surfactants

| Formula | 3.0% LP 100 | 5.0% LP 100 | 10.0% LP 100 |
|---|---|---|---|
| Clear Concentrate (RT)[1] | 2.76% | 3.12% | 9.16% |
| Stable Concentrate (RT/0F/122° F.)[2] | 5.00% | 7.00% | 10.50% |
| 10% 120° F. | 3.00% | 5.00% | 10.00% |
| 10% 150° F. | 4.50% | 6.50% | 10.50% |

[1]Clear Concentrate (RT) refers to the amount of hydrotrope added to the concentrate for it to be clear at room temperature only.
[2]Concentrate Stable refers to the amount of hydrotrope required to solubilize the concentrate at room temperature, freeze thaw (1 cycle) and 122° F. storage conditions.

Table 10 tabulates the weight ratios of Na capryl sulfonate:N-octyl pyrrolidone required to solubilize increasing levels of the latter, based on the numbers set forth in Table 9.

TABLE 10

Required Weight % Ratio of Na Capryl Sulfonate: N-Octyl Pyrrolidone Required to Solubilize Increasing Levels of N-Octyl Pyrrolidone (LP 100) (for FIG. 5 concentrates)

| Conditions | 3.0% LP 100 | 5.0% LP 100 | 10.0% LP 100 |
|---|---|---|---|
| Stable Concentrate | 1.7 | 1.4 | 1.05 |
| 10% 120° F. | 1.0 | 1.0 | 1.0 |
| 10% 150° F. | 1.5 | 1.3 | 1.05 |

a. 0.3% in 10% solutions, b. 0.5% in 10% solutions, c. 1.0% in 10% solutions

Table 11 sets forth the required weight percent ratio of Na Capryl sulfonate: N-octyl pyrrolidone required to solubilize N-octyl pyrrolidone (LP 100) as a function of the presence or absence of additional surfactants. The ratios calculated in Table 11 are based on the data set forth in Table 5 and FIG. 1, and in Table 9 and FIG. 5:

TABLE 11

Required Weight % Ratio of Na Capryl Sulfonate: N-Octyl Pyrrolidone Required to Solubilize N-Octyl Pyrrolidone (LP 100) As Function of Presence/Absence of Additional Surfactants

| Conditions | % LP 100 | Absence of Additional Surfactants (FIG. 1) | Presence of Additional Surfactants (FIG. 4) |
|---|---|---|---|
| Concentrate Stable | 3.0% | 2.7 | 1.7 |
| 10% 120° F. | 0.3% | 2.2 | 1.0 |
| 10% 150° F. | 0.3% | 2.7 | 1.5 |

d. Pluronic/Plurafac surfactant formulations described above.

Table 12 sets forth the required weight percent ratio of Na capryl sulfonate: N-dodecyl pyrrolidone required to solubilize N-dodecyl pyrrolidone (LP 300) as a function of the or presence or absence of additional surfactants. The ratios calculated in Table 12 are based on the data set forth in Table 6 and FIG. 2 and, Table 7 and FIG. 3.

TABLE 12

Required Weight % Ratio of Na Capryl Sulfonate: N-Dodecyl Pyrrolidone (LP 300) Required to Solubilize N-Dodecyl Pyrrolidone-Containing Concentrates As Function of Presence/Absence of Additional Surfactants

| Conditions | % LP 300 | Absence of Additional Surfactants (FIG. 1) | Presence of Additional Surfactants (FIG. 4) |
|---|---|---|---|
| Concentrate Stable | 3.0% | 3.3 | 1.7 |
| 10% 120° F. | 0.3% | 3.3 | 1.7 |
| 10% 150° F. | 0.3% | 4.3 | 2.5 |

d. Pluronic/Plurafac package described above.

The results of Tables 10, 11 and 12 indicate that the highest ratios of sodium capryl sulfonate/N-alkyl pyrrolidone are necessary when additional surfactants are not present (Table 11 and Table 12) and the lowest ratios are necessary for the highest weight %'s of N-alkyl pyrrolidone. Thus it can be seen that the required weight % ratios can be expected to fall between about 0.9 for the most readily solubilized N-alkyl-2-pyrrolidones and about 6.0 for the least readily solubilized N-alkyl-2-pyrrolidones.

It will be understood by those skilled in the art that various modifications may be made in the methods and compositions described above without departing from the spirit and scope of the present invention. Accordingly, it is intended that the specific embodiments described herein are intended as illustrative only, and that the invention is limited only by the claims appended hereto.

What is claimed is:

1. A method of making a cleaning concentrate comprising solubilizing an N—$C_{6-12}$ alkyl pyrrolidone in an aqueous medium at concentrations of at least 0.15% comprising admixing said N—$C_{6-12}$ alkyl pyrrolidone, a $C_{6-10}$ alkane sulfonate, 6 to 15 wt. % of an alkaline salt selected from the group consisting of alkaline metal carbonates, alkaline metal bicarbonates and mixtures thereof providing a pH greater than 10.0 and up to 13.0, and an aqueous medium to result in a cleaning concentrate, wherein said $C_{6-10}$ alkane sulfonate is present in a weight ratio to said N—$C_{6-12}$ alkyl pyrrolidone of about 0.9:1 to about 5.0:1.

2. The method of claim 1 wherein said cleaning concentrate further comprises at least one component selected from the group consisting of surfactants exclusive of both said N—$C_{6-12}$ alkyl pyrrolidone and said $C_{6-10}$ alkane sulfonate, alkaline silicates, and antifoaming agents.

3. The method of claim 1 wherein said cleaning concentrate further comprises;

(a) from 0 to 20 wt. % of a surfactant formulation;

(b) from 0 to 10 wt. % of an alkali metal silicate; and (c) from 0 to 8 wt. % of an antifoaming agent.

4. The method of claim 1 wherein the alkyl group of the N—$C_{6-12}$ alkyl pyrrolidone has 7 to 10 carbon atoms.

5. The method of claim 1 wherein the N—$C_{6-12}$ alkyl pyrrolidone is N-octyl pyrrolidone and the alkane sulfonate hydrotrope is sodium capryl sulfonate.

6. The method of claim 1 wherein the N—$C_{6-12}$ alkylpyrrolidone is N-dodecyl pyrrolidone and the alkane sulfonate hydrotrope is sodium capryl sulfonate.

7. A cleaning concentrate comprising an N—$C_{6-12}$ alkyl pyrrolidone, a $C_{6-10}$ alkane sulfonate, 6 to 15 wt. % of an alkaline salt selected from the group consisting of alkaline metal carbonates, alkaline metal bicarbonates and mixtures thereof providing a pH greater than 10.0 and up to 13.0, and an aqueous carrier, wherein said N—$C_{6-12}$ alkyl pyrrolidone is present in an amount of at least 0.15% of said concentrate, and wherein said $C_{6-10}$ alkane sulfonate and said N—$C_{6-12}$ alkyl pyrrolidone are present in a weight ratio of about 0.9:1 to about 5.0:1.

8. The cleaning concentrate of claim 7 further comprising at least one component selected from the group consisting of surfactants exclusive of both said N—$C_{6-12}$ alkyl pyrrolidone and said $C_{6-10}$ alkane sulfonate, alkaline silicates and antifoaming agents.

9. The cleaning concentrate of claim 7, further comprising (a) from 0 to 20 wt % of a surfactant formulation;

(b) from 0 to 10 wt. % of an alkali metal silicate; and (c) from 0 to 8 wt. % of an antifoaming agent.

10. A cleaning solution containing 1% to 20% of the concentrate of claim 7.

11. A cleaning solution containing 1% to 20% of the concentrate of claim 8.

12. A cleaning solution comprising an N—$C_{6-12}$ alkyl pyrrolidone, a $C_{6-10}$ alkane sulfonate, 6 to 15 wt. % of an alkaline salt selected from the group consisting of alkaline metal carbonates, alkaline metal bicarbonates and mixtures thereof providing a pH greater than 10.0 and up to 13.0, and an aqueous carrier, wherein said N—$C_{6-12}$ alkyl pyrrolidone is present in an amount of at least 0.15% of said solution, and wherein said $C_{6-10}$ alkane sulfonate and said N—$C_{6-12}$ alkyl pyrrolidone are present in a weight ratio of about 0.9:1 to about 5.0:1.

13. The cleaning solution of claim 12 further comprising at least one component selected from the group consisting of surfactants exclusive of both said N—$C_{6-12}$ alkylpyrrolidone and said $C_{6-10}$ alkane sulfonate, alkaline silicates, and antifoaming agents.

14. A method of preparing the cleaning concentrate of claim 7 comprising: admixing (a) a cleaning composition comprising an N—$C_{6-12}$ alkyl pyrrolidone and a $C_{6-10}$ alkane sulfonate, wherein said $C_{6-10}$ alkane sulfonate is present in a weight ratio to said N—$C_{6-12}$ alkyl pyrrolidone of about 0.9:1 to about 5.0:1 with 6 to 15 wt % of an alkaline salt selected from the group consisting of alkaline metal carbonate, alkaline metal bicarbonates and mixtures thereof providing a pH greater than 10.0 and up to 13.0, and an aqueous diluent.

15. A method of pre the cleaning solution of claim 12 comprising admixing a cleaning composition comprising an N—$C_{6-12}$ alkyl pyrrolidone and a $C_{6-10}$ alkane sulfonate, wherein said $C_{6-10}$ alkane sulfonate is present in a weight ratio to said N—$C_{6-10}$ alkyl pyrrolidone of about 0.9:1 to about 5.0:1 with 6 to 15 wt % of an alkaline salt selected from the group consisting of alkaline metal carbonates, alkaline metal bicarbonates and mixtures thereof providing a pH greater than 10.0 and up to 13.0, and an aqueous diluent.

16. A method of preparing a cleaning solution comprising diluting a cleaning concentrate with an aqueous diluent, wherein said cleaning concentrate comprises an N—$C_{6-12}$ alkyl pyrrolidone, a $C_{6-10}$ alkane sulfonate, 6 to 15 wt % of an alkaline salt selected from the group consisting of alkaline metal carbonates, alkaline metal bicarbonates and mixtures thereof providing a pH greater than 10.0 and up to 13.0, and an aqueous carrier, wherein said N—$C_{6-12}$ alkyl pyrrolidone is present in an amount of at least 0.15% of said concentrate, and wherein said $C_{6-10}$ alkane sulfonate and said N—$C_{6-12}$ alkyl pyrrolidone are present in a weight ratio of about 0.9:1 to about 5.0:1.

* * * * *